US005417492A

United States Patent [19]

Christian et al.

[11] Patent Number: 5,417,492

[45] Date of Patent: May 23, 1995

[54] APPARATUS FOR CONTINUOUSLY MIXING AND ELECTRICALLY HEATING FLOWABLE MATERIALS CONVEYED BY A PAIR OF ROTATABLE SCREWS

[75] Inventors: Robert F. Christian; Emil Z. Barish; Mikhail D. Mazur, all of San Francisco; Manuel M. Almojuela, Daly City; Noland F. Nicdao, San Francisco, all of Calif.

[73] Assignee: Christian Engineering, San Francisco, Calif.

[21] Appl. No.: 140,123

[22] PCT Filed: Apr. 13, 1992

[86] PCT No.: PCT/GB92/00676

§ 371 Date: Nov. 2, 1993

§ 102(e) Date: Nov. 2, 1993

[87] PCT Pub. No.: WO92/19372

PCT Pub. Date: Nov. 12, 1992

[30] Foreign Application Priority Data

May 7, 1991 [GB] United Kingdom ..... 9109814

[51] Int. Cl.[6] ..... B01F 15/06; B01F 7/08

[52] U.S. Cl. ..... 366/146; 366/85; 366/300; 366/301; 219/388; 219/421; 219/426; 222/146.5; 425/378.1; 425/DIG. 13

[58] Field of Search ..... 366/83-85, 366/144, 145, 146, 297-301; 222/146.5; 425/378.1, DIG. 13; 249/78; 219/200, 201, 388, 421, 426; 416/95

[56] References Cited

U.S. PATENT DOCUMENTS

| | | | |
|---|---|---|---|
| 2,802,238 | 8/1957 | Colombo | 366/85 |
| 3,055,053 | 9/1962 | Livingston et al. | 219/388 X |
| 3,109,913 | 11/1963 | Galajda, Jr. | 366/146 |
| 3,258,815 | 6/1966 | Smith . | |
| 3,299,473 | 1/1967 | Rorer et al. | 366/146 |
| 3,457,989 | 7/1969 | Nonnenmacher et al. . | |
| 3,525,124 | 8/1970 | Ocker . | |
| 3,586,819 | 6/1971 | Cairelli | 219/201 |
| 3,589,834 | 6/1971 | Cairelli . | |
| 3,884,607 | 5/1975 | Gerhards . | |
| 4,483,625 | 11/1984 | Fisher | 366/297 |
| 4,501,498 | 2/1985 | McKelvey | 366/145 X |
| 4,908,169 | 3/1990 | Galic et al. | 366/145 X |

FOREIGN PATENT DOCUMENTS

| | | | |
|---|---|---|---|
| 528968 | 11/1972 | Switzerland | 425/378.1 |

*Primary Examiner*—David A. Scherbel
*Assistant Examiner*—Charles Cooley
*Attorney, Agent, or Firm*—Nixon & Vanderhye

[57] ABSTRACT

An apparatus for continuously mixing and heating flowable materials comprises an inclined housing, at least two rotatable screws within the housing with each screw having a rotatably mounted shaft and a screw flight. The screws are arranged in parallel juxtaposition with their respective flights of opposite hand intermeshing. The shafts are driven in opposite rotation to each other and each shaft is hollow and is provided with electric heaters within the shaft for heating the flowable material.

11 Claims, 6 Drawing Sheets

APPARATUS FOR CONTINUOUSLY MIXING AND ELECTRICALLY HEATING FLOWABLE MATERIALS CONVEYED BY A PAIR OF ROTATABLE SCREWS

This invention relates to apparatus for continuously mixing and heating flowable materials such as liquids, powders, granular materials and other flowable materials including cakes, and residues.

Apparatus comprising a screw in a casing for conveying such materials is well known. It is also known that such screws may comprise a rotating hollow shaft carrying a hollow screw flight through which heat transfer media may be passed for heating the conveyed material. However for heating some materials steam or oil heating is not particularly practicable. For instance, pyrolysing treatment of pulverised coal requires a pyrolysing temperature of about one thousand degrees Fahrenheit. For this purpose a single screw device was tried many years ago in which the screw rotated alternately clockwise and anticlockwise but its use was discontinued long ago so presumably it was inefficient.

Heating hollow screws by steam or hot oil was unlikely to be suitable for such high temperatures. An alternative would be to pass molten salts through hollow screws. This has been tried, but unless the salt is totally evacuated from the screws on the shutdown, it freezes solid which involves considerable difficulties.

Another possibility could be to incorporate electrically heated rods in the shafts carrying the screw flights but this also involves practical difficulties and is of doubtful efficiency.

SUMMARY OF THE INVENTION

The object of the present invention is to devise improved apparatus for continuously mixing and heating flowable materials.

A further object of the invention is to provide more efficient heating means for heating a casing incorporating a pair of rotating screws having screw flights of One interleaving with the screw flights of the other so as to effect a mixing of the materials with enhanced uniformity of heating.

According to the present invention there is provided an apparatus for continuously mixing and heating flowable materials comprising a housing, at least two rotatable screws within said housing, each screw having a rotatably mounted shaft and a screw flight, said screws being arranged in parallel juxtaposition with their respective flights of opposite hand intermeshing, and means for driving said shafts in opposite rotation to each other, characterised in that each rotatably mounted shaft is hollow, that fixed support shafts extend within said rotatably mounted shafts, and that there are provided electric heaters respectively within said hollow shafts carried by said support shafts.

This arrangement has been tested and found to be most surprisingly efficient and practicable.

Also, according to the invention said support shafts may each carry a hollow cylinder on the exterior surface of which is mounted said heater.

The additional heater shaft with nearing elements may be provided in each of a pair of interleaved rotatable shafts.

BRIEF DESCRIPTION OF THE DRAWING FIGURES

The invention will be further described by way of example with reference to the accompanying diagrammatic drawings wherein.

DESCRIPTION OF A PREFERRED EMBODIMENT

Figure 1A:
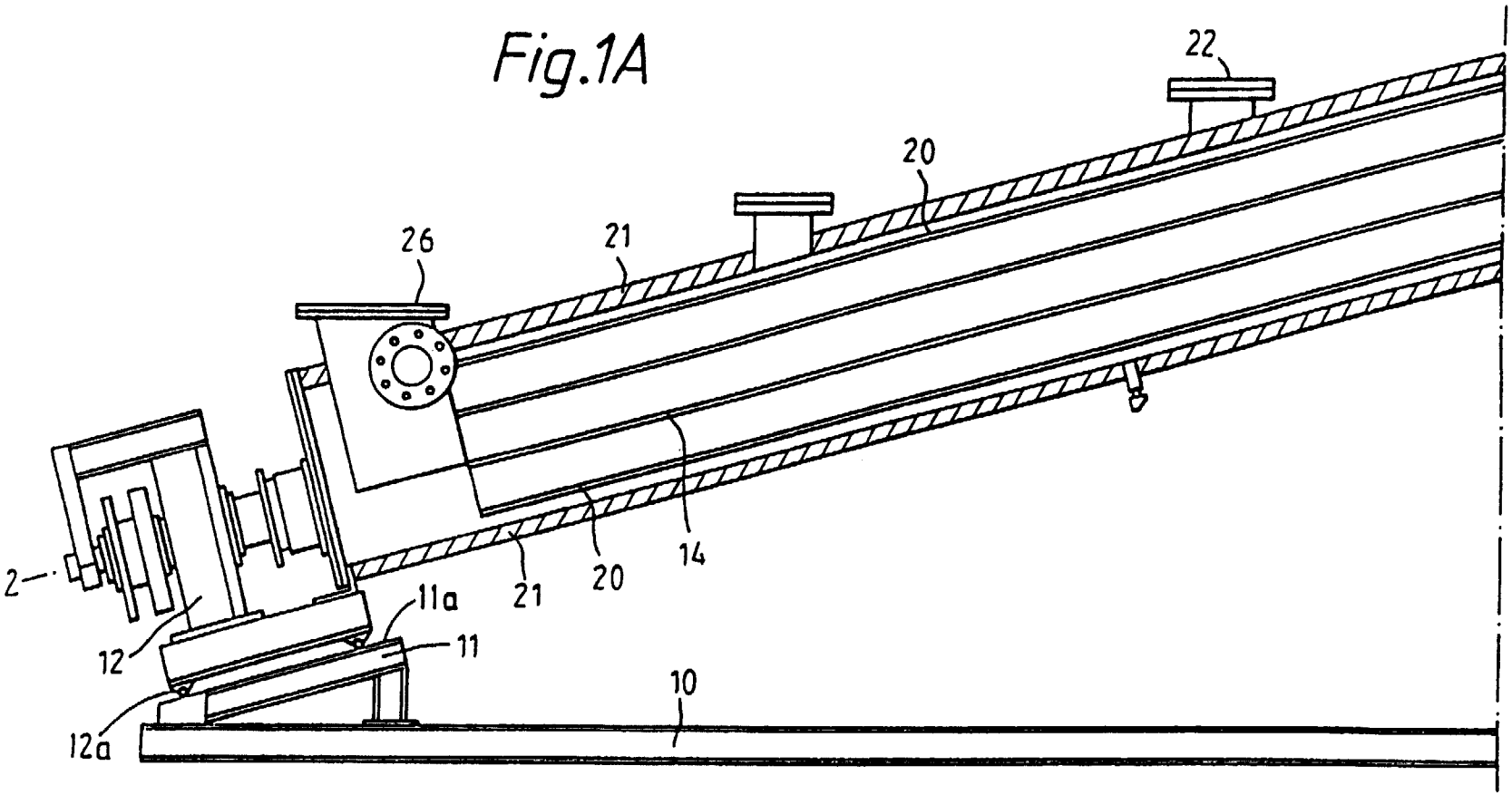
FIGS. 1A and 1B are an elevational view of a screw conveying apparatus made in accordance with the invention.

The apparatus comprises a base 10, a support 11 having an inclined upper track 11*a*, an upright drive bearing housing 12 mounted on rollers 12*a* engaging said track 11*a* to permit movement of said housing to accommodate expansion and contraction of the apparatus, a casing 20, and screws 8, 9 within said casing arranged in parallel juxtaposition relative to each other and inclined at 3 to 25%.

The screws 8, 9 comprise respectively rotatable hollow shafts 13, 14 and screw flights 18, 19 fixed thereon. The casing 20 which in turn is preferably arranged within a heat insulating jacket 21, is mounted at the lower end on a fixed part of the bearing housing 12 and at its upper end on a fixed part of a bearing housing 23 at the upper delivery end. The jacket 21 is provided with openings 22, 26 for the purpose of the removal of vapour or for visual inspection.

The screws 8, 9 are mutually spaced so that the screws intermesh with their flights mutually overlapping (i e interleaved) and in close proximity to each other but not touching.

The housing 20 has an inlet 26 at its lower end in which material to be treated is introduced. An outlet chute 28 at the upper end of the housing 20 leads to an inlet cooling conveyor 29, which may be one of several known types.

Figure 2A:
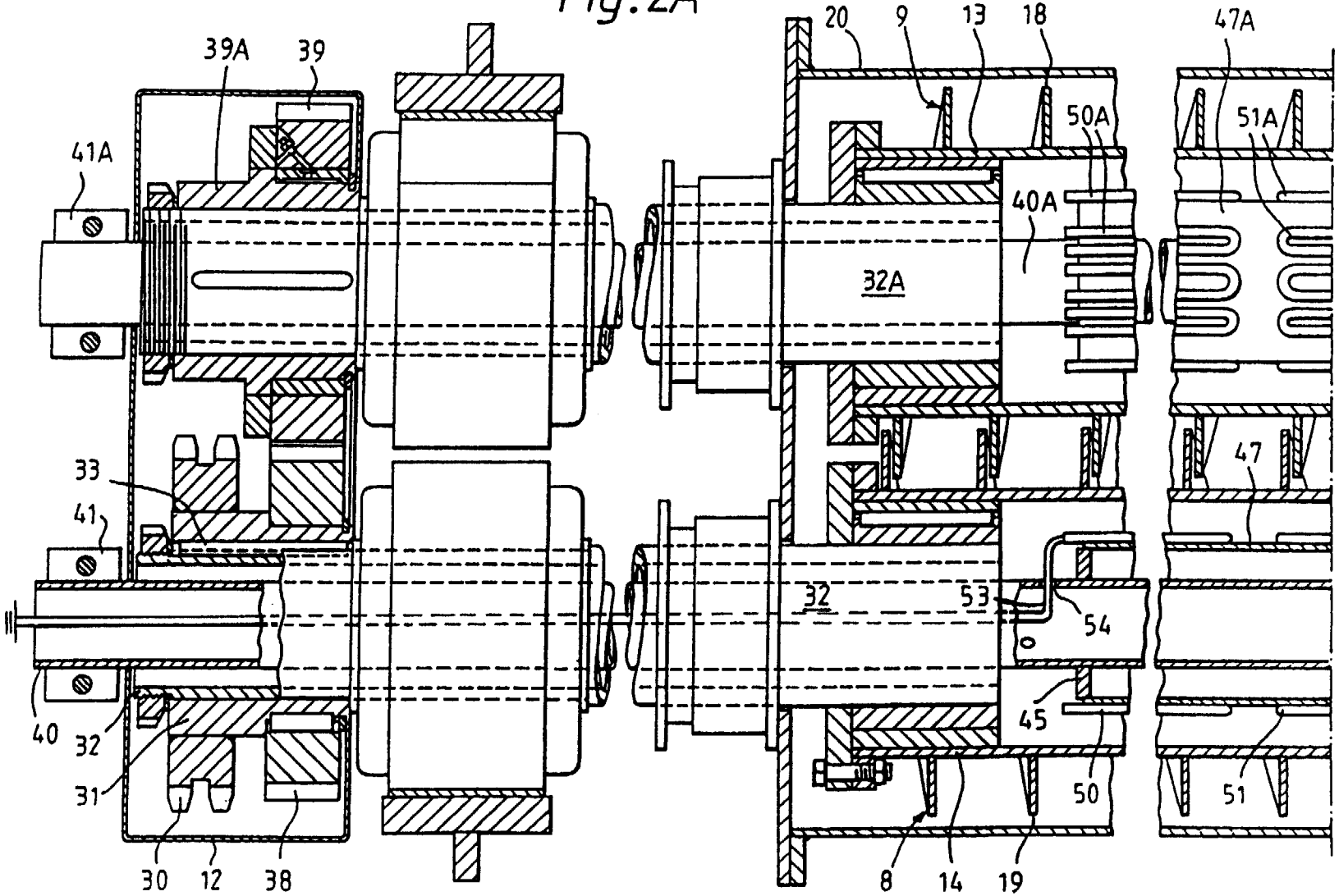
FIGS. 2A and 2B are a sectional view on the plane 2—2 on FIG. 1.

As shown in FIG. 2A the bearing housing 12 contains an input sprocket 30 on a hub 31 which is keyed to a stub axle shaft 32 by a key 33. The hub carries a gearwheel 38 which meshes with a gearwheel 39 which rides freely on hub 39A over a limited arc to form part of a lost motion device, which hub 39A is connected to a hollow shaft 32A. The shafts 32, 32A are connected respectively by bushes and keys to the screw shafts 14, 13. The intermeshing 9ears are driven in opposite directions.

The shafts 13, 14 are connected at the output end by rings 34, 34A and plates 35, 35A to shafts 36, 36A mounted in bearings 37, 37A.

Located coaxially within the hollow shafts 32, 32A; 14, 13; 36, 36A; and spaced from the shaft 14; 13 are respectively provided non-rotatable hollow shafts 40, 40A supported beyond the shafts 32, 32A; 14, 13; by a support 41, 41A at one end and a support 42, 42A at the other end.

Within hollow shafts 13, 14 and fixed to the shafts 40, 40A are plates 45, 46 spaced apart and carrying hollow cylinders 47, 47A which extend over a major portion of the axial length of the shafts 13, 14. Fixed in the outside of the hollow cylinders are a series of electric heater U-shaped or straight elements 50, 50A at one end and a similar series of electric heater elements 51, 51A at the other end, The elements 50, 51 have electrical connections 53, 56 which pass through holes 54, 55 into the interior of the shaft 40 where they pass axially through to an exterior source of electricity supply as illustrated in FIG. 2A.

Although U-shaped elements are shown for two separately control led heating zones, straight tubes for single control may also be used.

The heat from the elements is transmitted by radiation to the shafts 13, 14 and the flights 18, 19 also become heated so that by the heated shafts and flights, assisted by the mixing action, the coal particles or other materials are efficiently raised to the required high temperature.

Figure 1B:
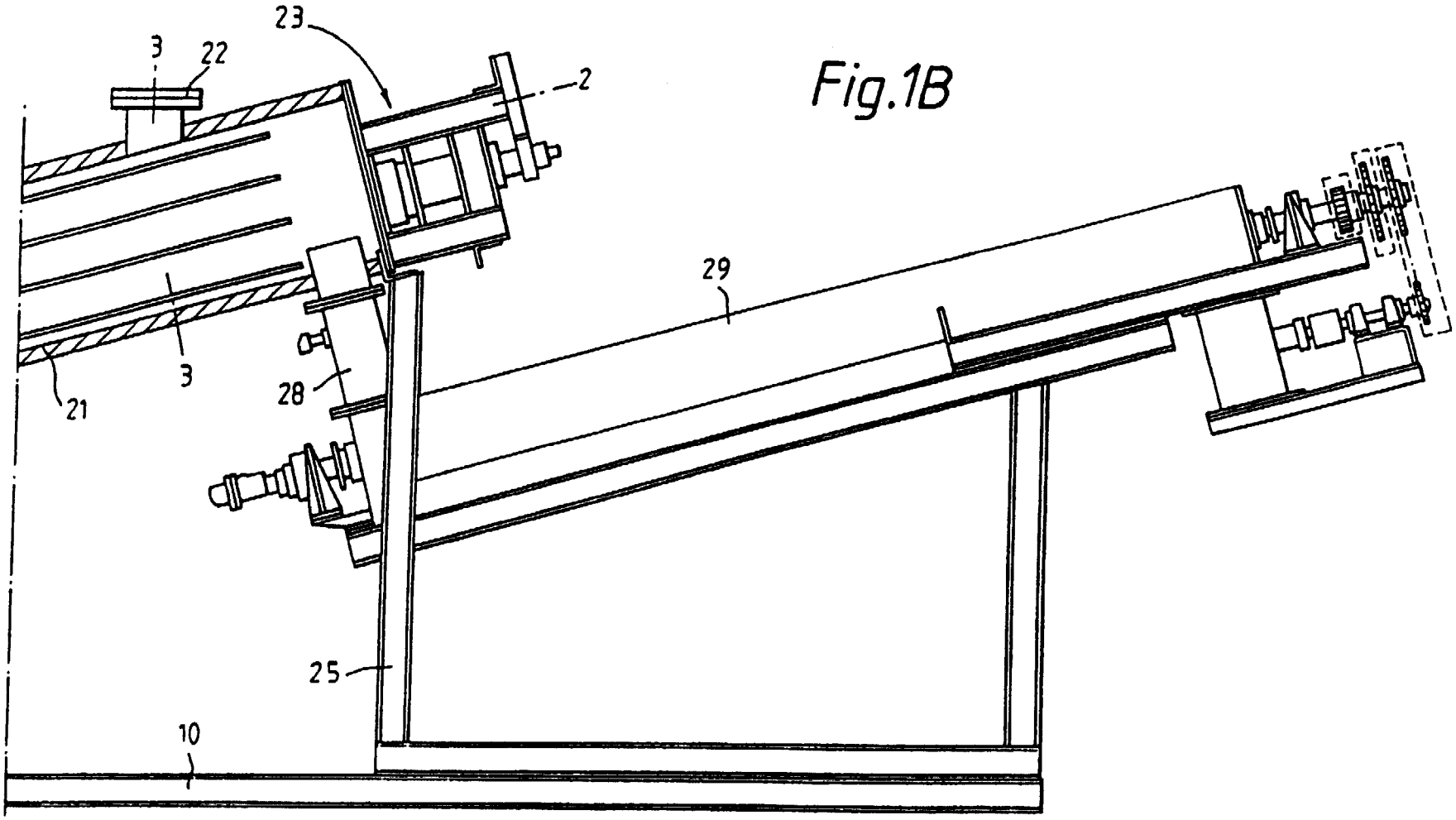
Figure 2B:
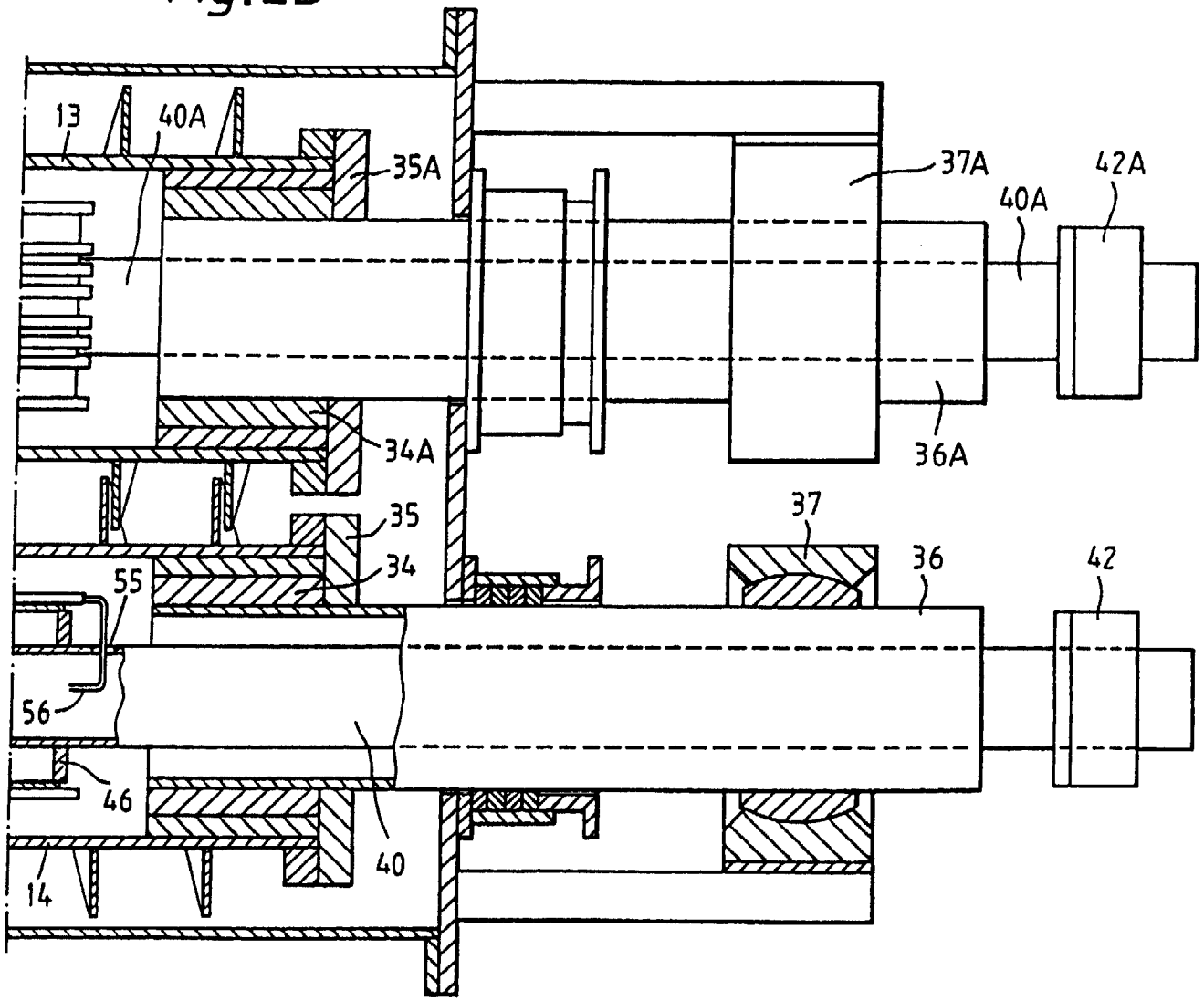
Figure 3:
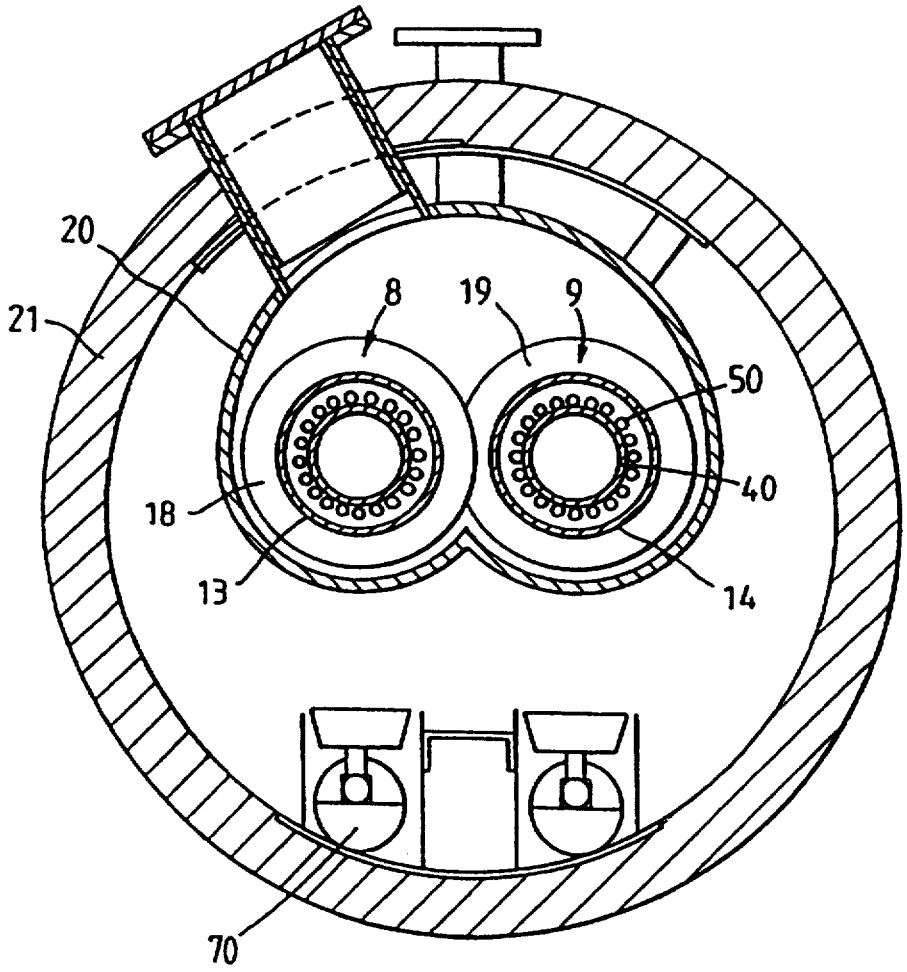
FIG. 3 is a sectional view on the plane 3—3 on FIG. 1.
Figure 4:
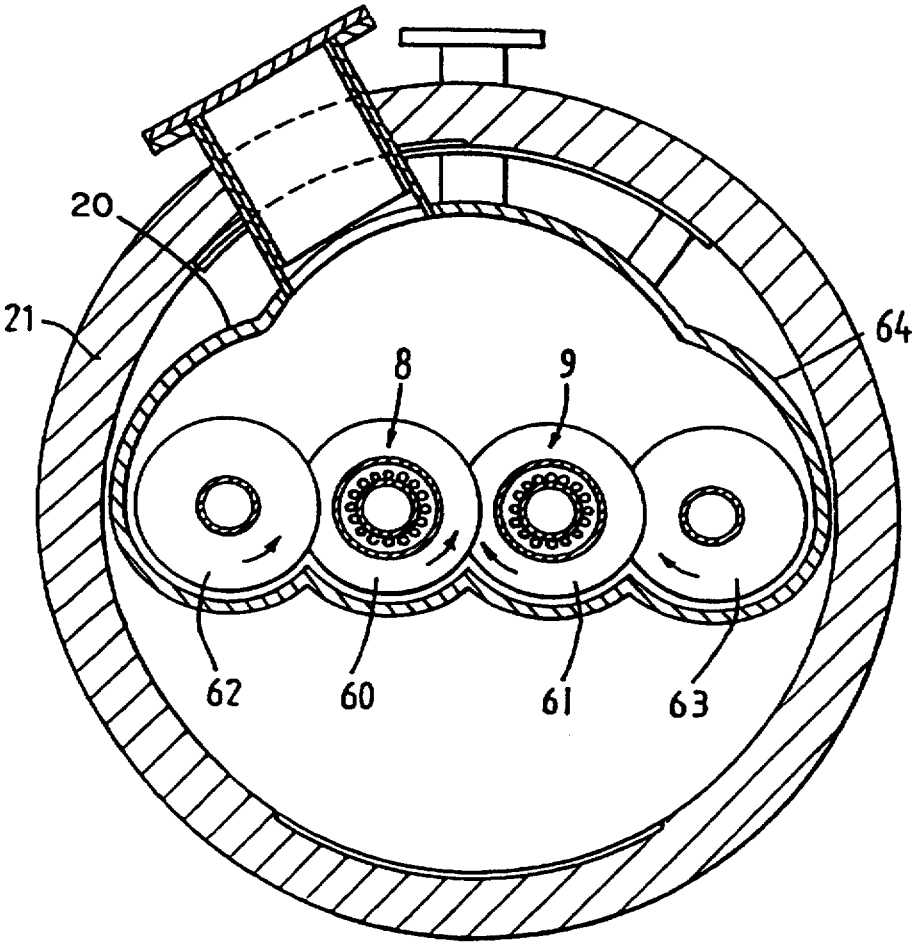
FIG. 4 shows a sectional view of a modification of the apparatus in which four screws are provided.

An alternative embodiment is shown in FIG. 4, which may embody any of the features of the example described with reference to FIGS. 1 to 3. In this arrangement further flighted screws (62, 63) are provided within said housing 20 on axes parallel to the axes of the opposite hand intermeshing screws 60, 61, said further screws respectively interleaving with the intermeshing screws 60, 61 and being of the same pitch and hand thereof and serving to clean the flights of said intermeshing screws. The further screws may or may not have heaters.

The use of four screws achieves a doubling of the throughput capacity over the twin screw apparatus.

In another modification the outer screws may be multiple lead or extended lead screws driven at different speeds.

In operation material fed to the lower end of the apparatus by way of the inlet 26 may be gathered up by the intermeshing screws 8, 9; 60, 61 from beneath on commencement of rotation. For ease of operation and to prevent jamming, the rotational direction is reversed after several revolutions, whereafter the screws are again driven in a forward and upward feed movement.

It is preferable that the drive mechanism for the screws be provided within the lowermost bearing housing which, due to the extension of the stub shafts, can be disposed at a distance from the screw housing. In this way, the drive mechanism is not exposed to the heat from the hot gases which are at their higher temperature at the delivery end of the housing.

By fixing the heating elements relative to the rotating screws efficient and uniform heating of the screws is achieved. Connection of the elements is simply achieved. Further, the elements may also be readily removed for maintenance or change of heat output rating.

The apparatus described in the above examples may be used for the pyrolysing of coal products to drive off unwanted moisture. In this case, as shown in FIG. 3, gas burners 70 may also be used. However, for the treatment of oil residues (known as "bottoms") the burners are not required.

For the treatment of "bottoms" the apparatus is equipped to operate at temperatures in the region of 1200° F. (649° C.). The finely granular product is found to be uniformly dry.

We claim:

1. An apparatus for continuously mixing and heating flowable materials comprising:

an inclined housing;

at least two rotatable screws within said housing, each screw having a rotatably mounted hollow shaft and a screw flight, said screws being arranged in parallel juxtaposition with their respective flights being of opposite hand intermeshing;

means for driving said shafts in opposite rotation to each other;

fixed support shafts extending within said rotatably mounted shafts, respectively, each said support shaft carrying a hollow cylinder having an exterior surface; and electric heaters respectively within said hollow shafts and fixed to said support shafts, respectively, on said exterior surfaces of said hollow cylinders.

2. An apparatus as claimed in claim 1 wherein each said heater comprises a plurality of elongate heating elements.

3. An apparatus as claimed in claim 2, characterised in that said elongate heating elements are substantially U-shaped.

4. An apparatus as claimed in claim 3, characterised in that the U-shaped heating elements for each cylinder are arranged in two groups located adjacent opposite ends thereof, respectively, the groups for each cylinder together extending substantially the entire length of the cylinder.

5. An apparatus as claimed in claim 2, characterised in that each of the hollow cylinders and the elongate heating elements are contained wholly within said rotatably mounted shafts, respectively, and extend over a major portion of the length of said shafts.

6. An apparatus as claimed in claim 5, characterised in that connections for said heating elements pass through holes in said support shafts and extend therethrough to an exterior source of electrical supply.

7. An apparatus as claimed in claim 1 characterised in that pairs of hollow stub axles carry said screws, said axles being drivably connected to the hollow shafts of the screws, said screws having upper and lower ends, and upper and lower bearing housings for supporting the stub axles at said upper and lower ends of the screws, respectively.

8. An apparatus as claimed in claim 7, characterised in that said driving means is provided within said lower bearing housing.

9. An apparatus as claimed in claim 8, characterised in that said driving means comprises a pair of hubs in driving relation to said stub axles, respectively, a pair of intermeshing gear wheels mounted on said hubs, respectively, and an input drive sprocket mounted on one of said hubs.

10. An apparatus as claimed in claim 8, characterised in that said lower bearing housing is mounted on rollers which run on an inclined track.

11. An apparatus as claimed in claim 7, characterised in that a heat insulating jacket is supported between said upper and lower bearing housings, said jacket surrounding the housing and screws.

* * * * *

UNITED STATES PATENT AND TRADEMARK OFFICE

CERTIFICATE OF CORRECTION

PATENT NO. : 5,417,492

DATED : May 23, 1995

INVENTOR(S) : CHRISTIAN ET AL

It is certified that error appears in the above-indentified patent and that said Letters Patent is hereby corrected as shown below:

Column 4, line 4, delete "an inclined" and insert --a--.

Signed and Sealed this

Eighteenth Day of July, 1995

*Attest:*

Bruce Lehman

BRUCE LEHMAN

*Attesting Officer*

*Commissioner of Patents and Trademarks*